US006418760B1

(12) United States Patent
Fettes

(10) Patent No.: US 6,418,760 B1
(45) Date of Patent: Jul. 16, 2002

(54) CAM-TYPE LATCH WITH LOCK

(76) Inventor: Ian J. Fettes, 2412 Holly La., Newport Beach, CA (US) 92663

( * ) Notice: Subject to any disclaimer, the term of this patent is extended or adjusted under 35 U.S.C. 154(b) by 0 days.

(21) Appl. No.: 09/578,357

(22) Filed: May 24, 2000

Related U.S. Application Data

(60) Provisional application No. 60/136,728, filed on May 28, 1999.

(51) Int. Cl.[7] ..... E05B 57/00; E05B 63/00; E05B 65/00; A45C 13/00

(52) U.S. Cl. ..... 70/71; 70/58; 70/69; 70/70; 70/72; 70/73; 70/74; 70/75; 24/71 J; 24/70 J; 24/265 WS; 24/336; 24/616; 24/618; 24/273; 24/167; 24/614; 24/625; 292/325; 292/91; 292/210; 292/89

(58) Field of Search ..... 70/69–75, 58; 24/71 J, 70 J, 265 WS, 644, 336, 616, 618, 645, 338, 273, 337, 339, 167, 614, 625; 292/325, 91, 210, 89

(56) References Cited

U.S. PATENT DOCUMENTS 4,545,094 A * 10/1985 Fontana ..... 24/71 J
4,546,505 A * 10/1985 Wakenshaw ..... 4/543
4,912,950 A * 4/1990 Crowlle ..... 70/58
5,400,477 A * 3/1995 Marega et al. ..... 24/685 K

FOREIGN PATENT DOCUMENTS

| | | | |
|---|---|---|---|
| EP | 0557578 A1 | * | 9/1993 |
| EP | 1084644 A1 | * | 3/2001 |
| FR | 2474972 A1 | * | 8/1981 |
| FR | 2549730 A1 | * | 2/1985 |

* cited by examiner

*Primary Examiner*—William A. Cuchlinski, Jr.
*Assistant Examiner*—Ronnie Mancho
(74) *Attorney, Agent, or Firm*—Larry K. Roberts

(57) ABSTRACT

A mechanism for converting between rotational and linear movement includes a rotatable hub structure and a striker element having an inboard end and an outboard end. In one form of the mechanism, a pivot/spring structure is positioned to engage a pivot location on the striker element between the inboard and outboard ends of the striker element. The pivot/spring structure provides a deflectable pivot fulcrum which can be deflected from a pivot rest position in response to a deflecting force exerted on the striker element. The hub structure can be engaged with the inboard end of the striker element so that a rotational movement of the hub structure provides a force on the striker element tending to cause the inboard end to pivot about the pivot structure, deflecting the pivot fulcrum such that the outboard end of the striker element moves in a generally axial direction. The mechanism can be used in a latch.

26 Claims, 16 Drawing Sheets

CAM-TYPE LATCH WITH LOCK

CROSS-REFERENCE TO RELATED APPLICATION

This application claims the benefit of U.S. Provisional Application No. 60/136,728, filed May 28, 1999, the entire contents of which are incorporated herein by this reference.

TECHNICAL FIELD OF THE INVENTION

This invention relates to techniques for converting rotary motion to linear motion, and is particularly useful in a locking latch mechanism for use on applications such as securing spa covers.

BACKGROUND OF THE INVENTION

Residential spas are widespread sources of enjoyment and relaxation. Such spas are typically formed with dimensions several feet on a side. Spas may be located in the ground, within a gazebo, or surrounded by a deck. They are preferably covered when not in use both to maintain water temperature and to prevent contamination of the spa water.

Applicant has disclosed inventions for lifting spa covers in U.S. application Ser. No. 08/781,804, filed Jan. 10, 1997, "Device For Aiding Removal And Replacement Of A Spa Cover," and application Ser. No. 08/985,076, filed Dec. 4, 1997, the entire contents of which are incorporated herein by this reference.

One particular application for this invention is provide a technique to secure a web strap in place to hold down a spa cover. The invention has utility in other applications as well.

SUMMARY OF THE INVENTION

In accordance with one aspect of the invention, a mechanism is described for converting between rotational and linear movement. The mechanism includes a rotatable hub structure and a striker element having an inboard end and an outboard end. A pivot/spring structure is positioned to engage a pivot location on the striker element between the inboard and outboard ends of the striker element. The pivot/spring structure provides a deflectable pivot fulcrum which can be deflected from a pivot rest position in response to a deflecting force exerted on the striker element. The hub structure is positioned for engagement with the inboard end of the striker element so that a rotational movement of the hub structure provides a force on the striker element tending to cause the inboard end to pivot about the pivot structure, deflecting the pivot fulcrum such that the outboard end of the striker element moves in an axial direction.

In accordance with another aspect of the invention, a latch is described, comprising a base structure and a handle structure mounted to the base structure for pivoting movement about a handle pivot between an open position and a latch position. The base structure includes a flange member positioned adjacent the latch position and including an aperture formed therein. A latch mechanism is carried on the handle structure, and includes a rotatable hub structure and a striker element having an inboard end and an outboard end. The striker element is movable from a rest position wherein the outboard end protrudes into the base structure aperture when the handle is in the latch position to a release position wherein the outboard end is disposed out of the flange aperture. A pivot/spring structure is positioned to engage a pivot location on the striker element between the inboard and outboard ends of the striker element, to provide a deflectable pivot fulcrum which can be deflected from a pivot rest position in response to a deflecting force exerted on the striker element. The hub structure is positioned for engagement with the inboard end of the striker element so that a rotational movement of the hub structure provides a force on the striker element, deflecting the pivot fulcrum such that the outboard end of the striker element moves inwardly from the rest position to release the latch.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

In an exemplary application for this invention, a spa is provided with one or more web straps which are latched in place to secure the cover in a closed position. The purpose is to hold the cover down in the closed position in high wind conditions, and to deter small children from lifting the spa cover.

Figure 1:
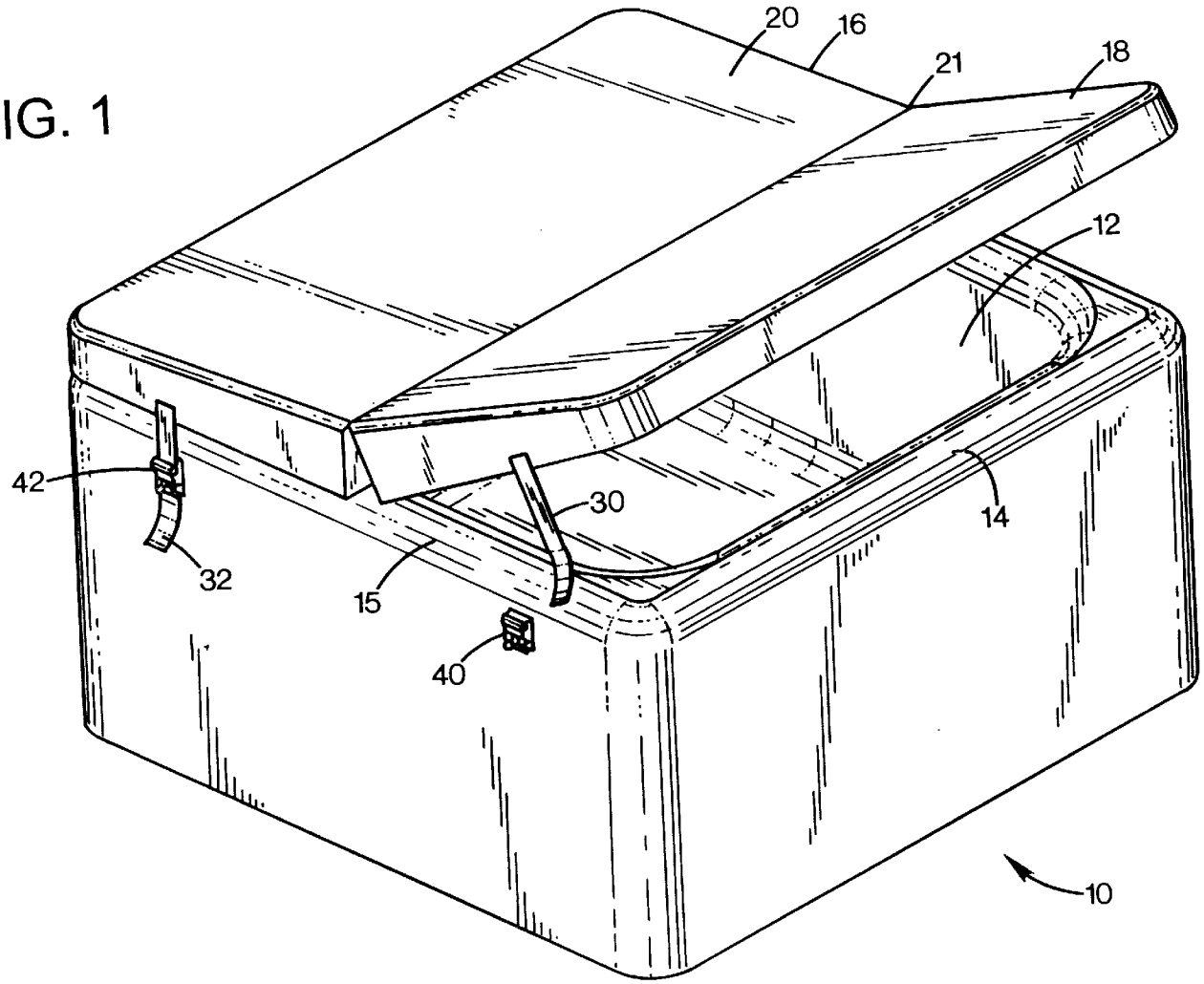
FIG. 1 is an isometric view of a spa and spa cover with a strap and latch system.

FIG. 1 shows in isometric view a generally rectangular spa 10, with a strap and latch system in accordance with the invention. The spa 10 may be a prefabricated, fiberglass structure in which a concave, upwardly facing tub 12 has a generally rectangular cover 16 disposed at the top thereof. The spa cover 16 is typically formed of a thermally insulating, water insensitive material, e.g. rigid polyurethane, enclosed within a waterproof fabric casing such as vinyl plastic. The peripheral edges of the spa cover 16 are supported about the perimeter of the tub 12 by upright vertical end walls 14 and upright vertical side walls 15.

The spa cover 16 is divided longitudinally into two halves 18 and 20 which are hinged together by a transversely-extending hinge 21. The spa cover portion 18 can be unfolded from a position on top of the spa cover portion 20 to extend horizontally as indicated as shown in FIG. 1. When the spa cover portion 20 is in the horizontal covering position illustrated in FIG. 1, and the spa cover portion 18 is unfolded to extend longitudinally therefrom to the unfolded position, the spa cover 16 is in its completely closed position and covers the entire surface of the water within the spa tub 12. The spa cover 16 rests on the upper edges of all of the walls 14 and 15 when it is completely closed in this manner.

To open the spa cover 16 from its fully closed position, the user first folds back the spa cover portion 18 about the hinge 21 until the spa cover portion 18 rests on top of the spa cover portion 20. At this point half of the water surface of the spa 10 in the tub 12 is covered while the other half is exposed. The cover can then be lifted upright using a lift system, e.g. as described in the above-referenced patent applications, or removed entirely from the spa.

To hold the cover in the closed position, a set of securing members, e.g. NYLON web straps 30, 32 are attached to the cover and engaged in corresponding latches, e.g. latches 40, 42 attached to the side walls of the spa. While FIG. 1 shows the straps and latches on only one side, it is to be understood that two other straps and latches are preferably employed on the opposed side wall. Of course, a fewer or a greater number of straps and latches can be employed for particular applications.

Figure 2:
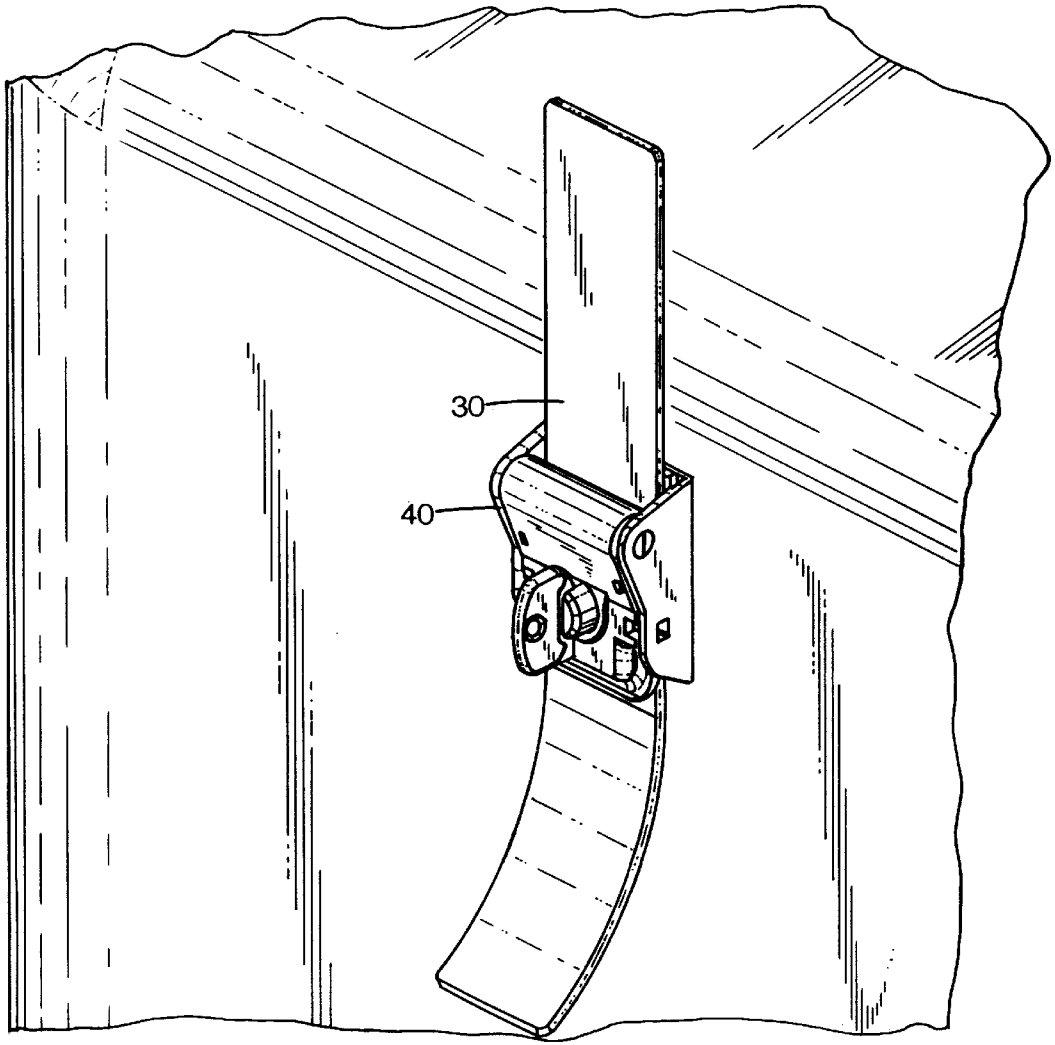
FIG. 2 is a close-up view of one strap and latch of the system of FIG. 1, with the strap inserted through the latch and the latch closed.
Figure 3:
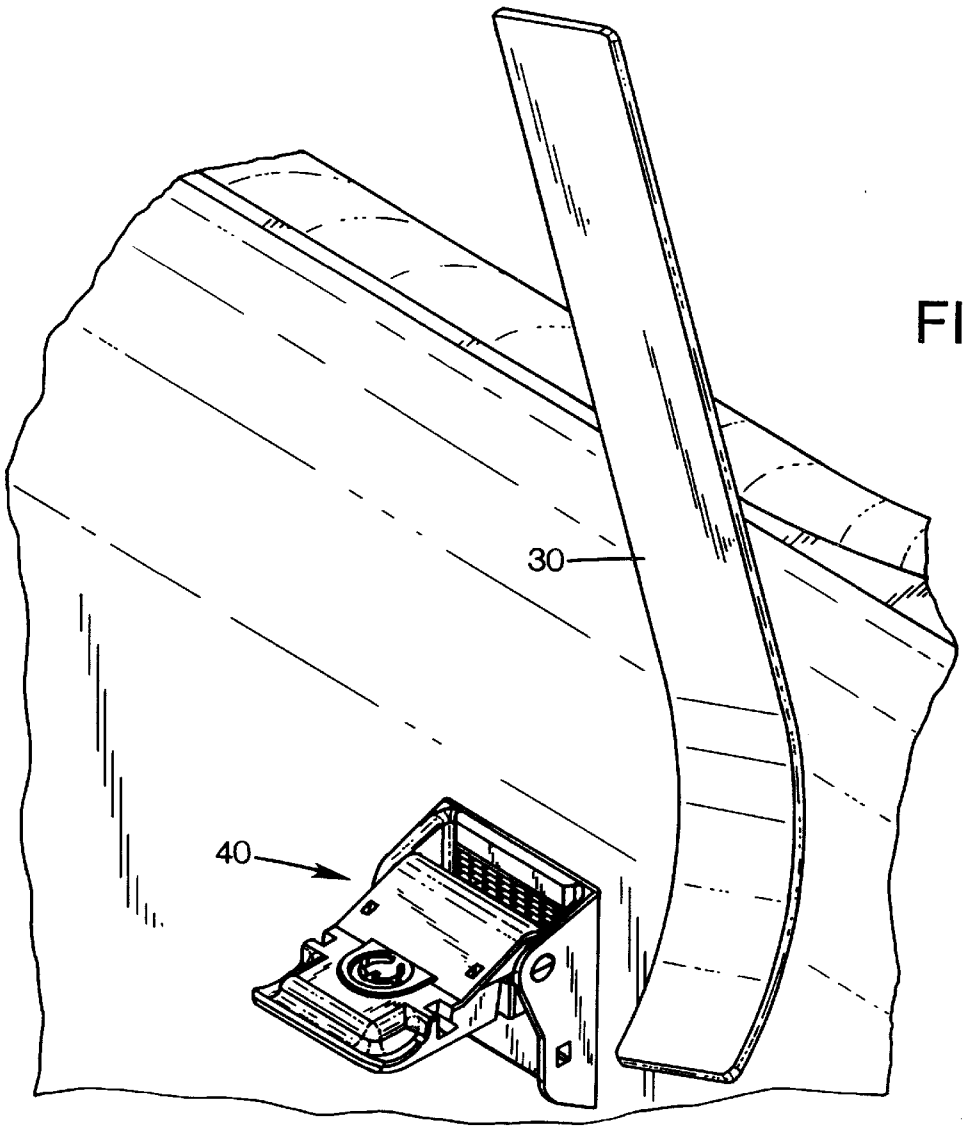
FIG. 3 is a view similar to FIG. 2, but with the latch opened, and the strap pulled out of the latch to allow the cover to be opened.

FIG. 2 is a close-up view of strap 30 and latch 40, with the strap inserted through the latch and the latch closed. FIG. 3 is a similar view, but with the latch opened, and the strap pulled out of the latch to allow the cover to be opened.

The latches used in this strap and latch system are of a locking latches in accordance with an aspect of the invention. While the latches can be set to the closed and locked position without the use of a key, a key is employed to open the latch.

Locking latch 40 is illustrated in further detail in FIGS. 4–12. The latch includes a base structure 402, and a handle 404 which is mounted to the base structure and pivots from the open position shown in FIG. 4A to a closed position clamping a strap. The closed position for the latch 42 is illustrated in FIG. 1. The handle carries a rotatable hub 410, and a pair of opposed striker elements 412, 414. A backplate 406 is assembled to the handle, and holds the striker elements 412, 414 and hub 410 in place. The backplate also includes respective pivot/spring elements 406A, 406B whose functions are described below. A key 408 engages features on the hub, and is used to turn the hub to move the distal ends of the striker elements out of slots 402A, 402B formed in the handle to allow the handle to be moved from the closed position to the open position.

In this exemplary embodiment, the foregoing elements of the latch are fabricated using injection molding techniques. An exemplary material useful for the purpose is a glass-fiber-filled polyamid, e.g. NYLON (TM) 6/6. This particular material has sufficient rigidity that if the latch is forced open without a key, breakage of parts of the latch will likely occur, providing evidence of tampering. Of course other materials could be employed, including for the striker elements a flexible metal material.

Figure 4A:
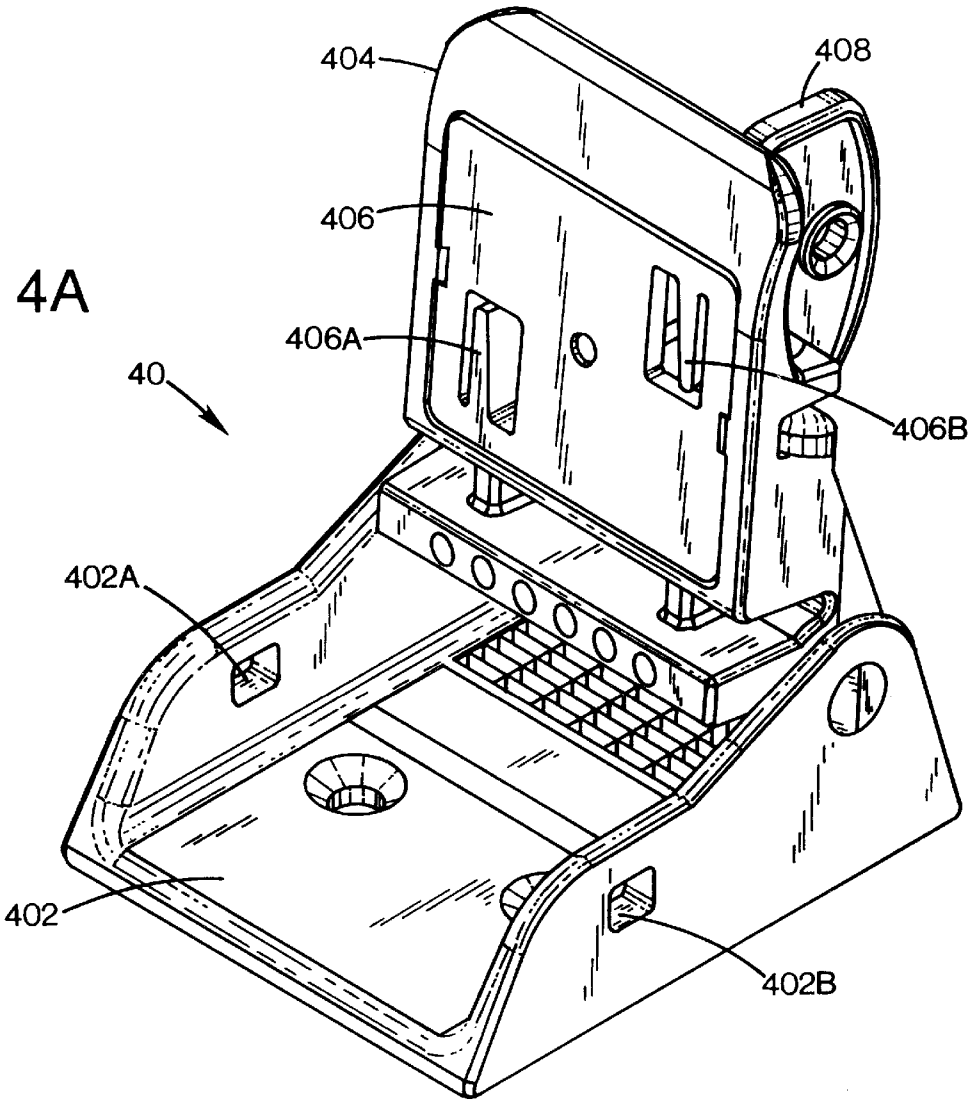
FIG. 4A is an isometric view of the latch in fully assembled form.

The latch 40 is shown in assembled form in FIG. 4A, with the handle 404 in the raised, latch-opened position.

Figure 4B:
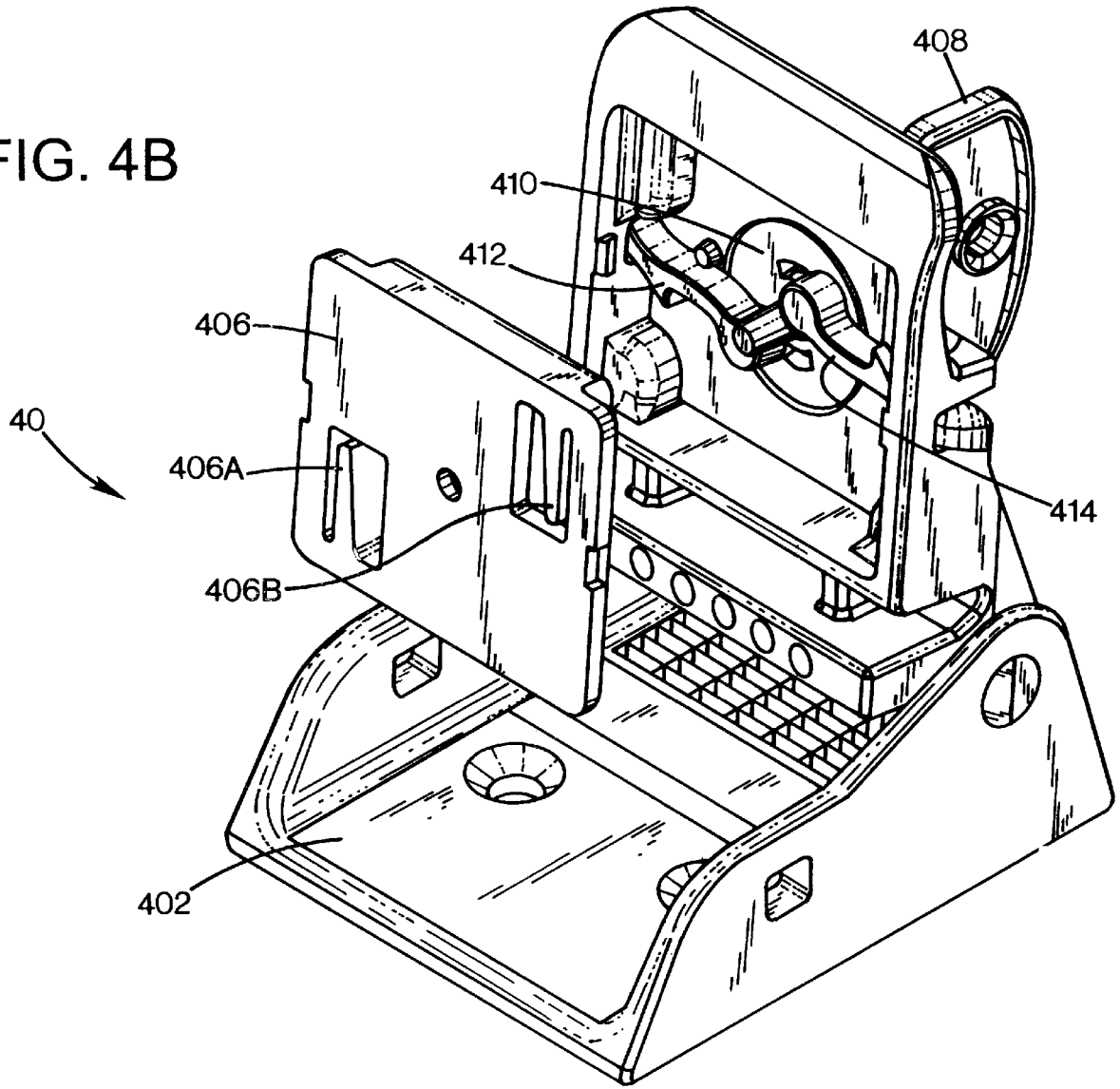
FIG. 4B is an isometric view of the latch, showing the baseplate disassembled from the handle.
Figure 11:
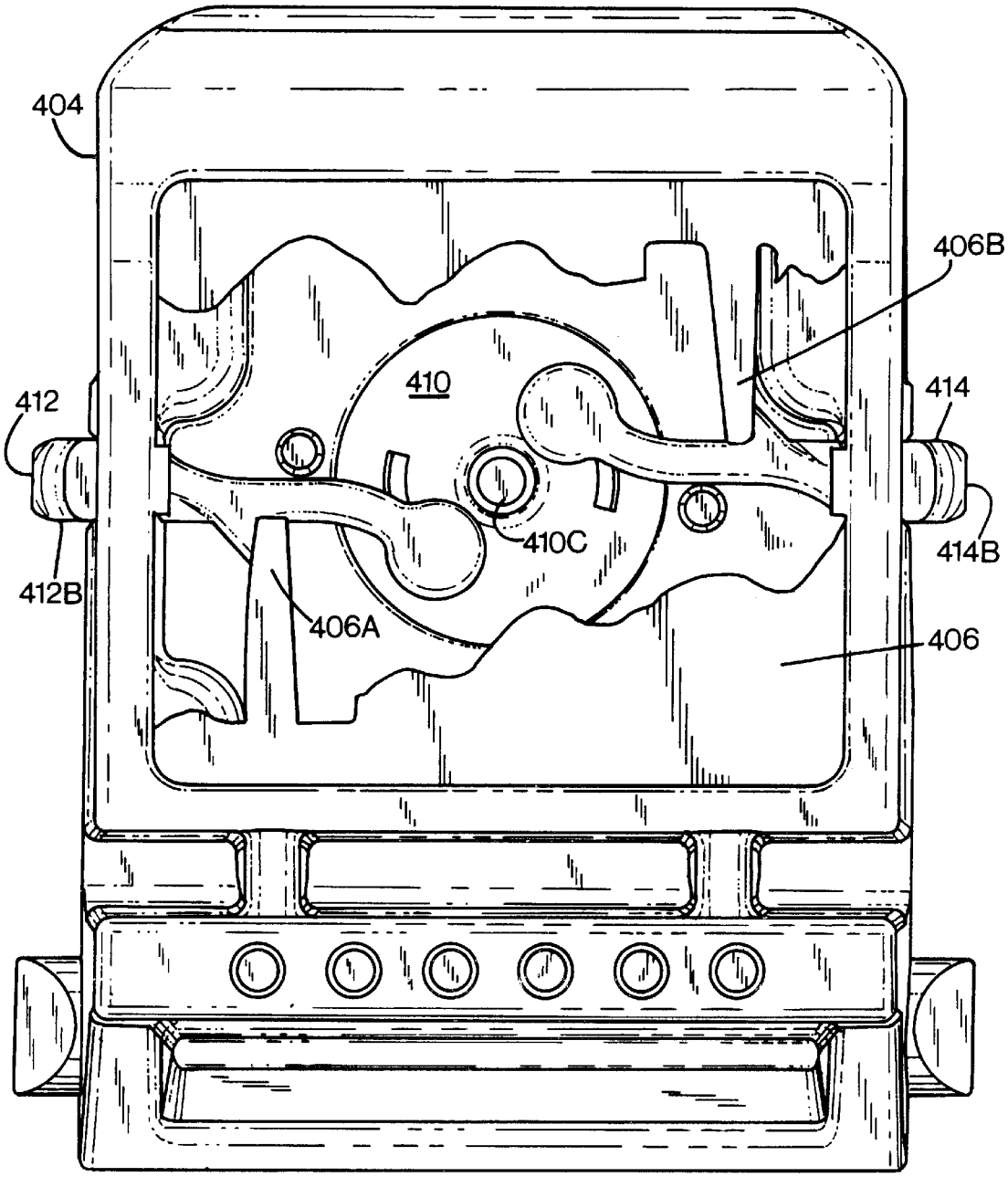
FIG. 11 is an isometric view of the latch, with the backplate in exploded view relative to the handle, showing the assembly of the two strikers and the hub with the handle.

FIG. 4B is an isometric view of the latch 40 with the handle 404 in the raised position but with the backplate 406 in exploded view relative to the handle. FIG. 4B shows the assembly of the two strikers 412, 414 and the hub 410 with the handle. FIG. 11 is a partial front view of the latch with the handle in the raised position, and the backplate partially broken away, to show the detail of the assembly of the strikers 412, 414 and the hub 410 with the handle.

Figure 5:
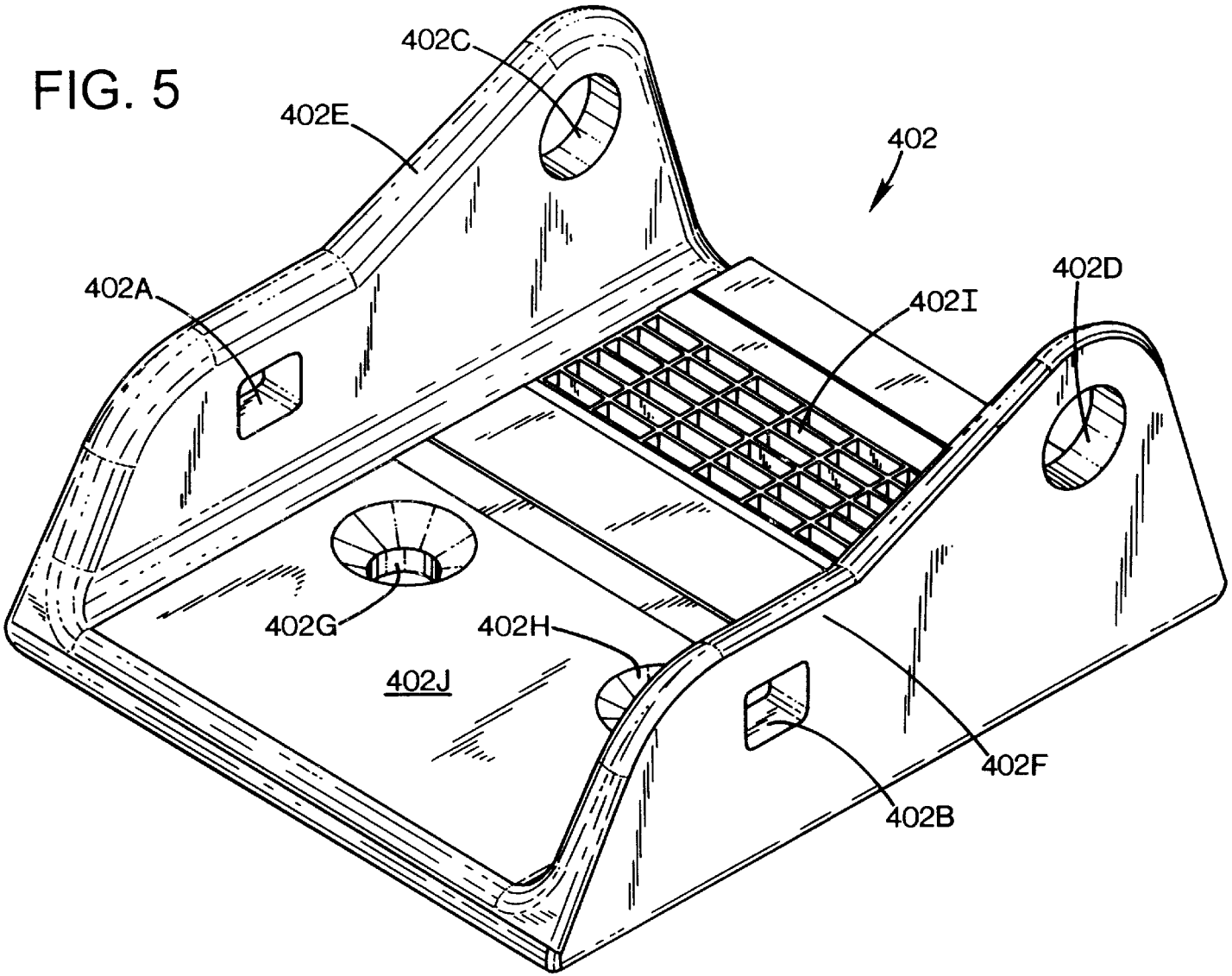
FIG. 5 is an isometric view illustrating the base member of the latch assembly.

FIG. 5 shows the base 402 is isometric view. The base has a floor region 402J and upstanding wall sections 402E, 402F. The apertures 402A, 402B which receive the distal ends of the striker elements are formed in the wall sections 402E, 402F, as are openings 402C, 402D which receive hinge pin portions 404A, 404B (FIG. 6) of the handle 404. A roughened surface portion 4041 is provided to provide increased mechanical engagement contact with the web 303 when the handle is closed on the web. Holes 402G, 402H are provided to receive fasteners such as flat-headed screws to mount the handle to the spa surface.

Figure 6:
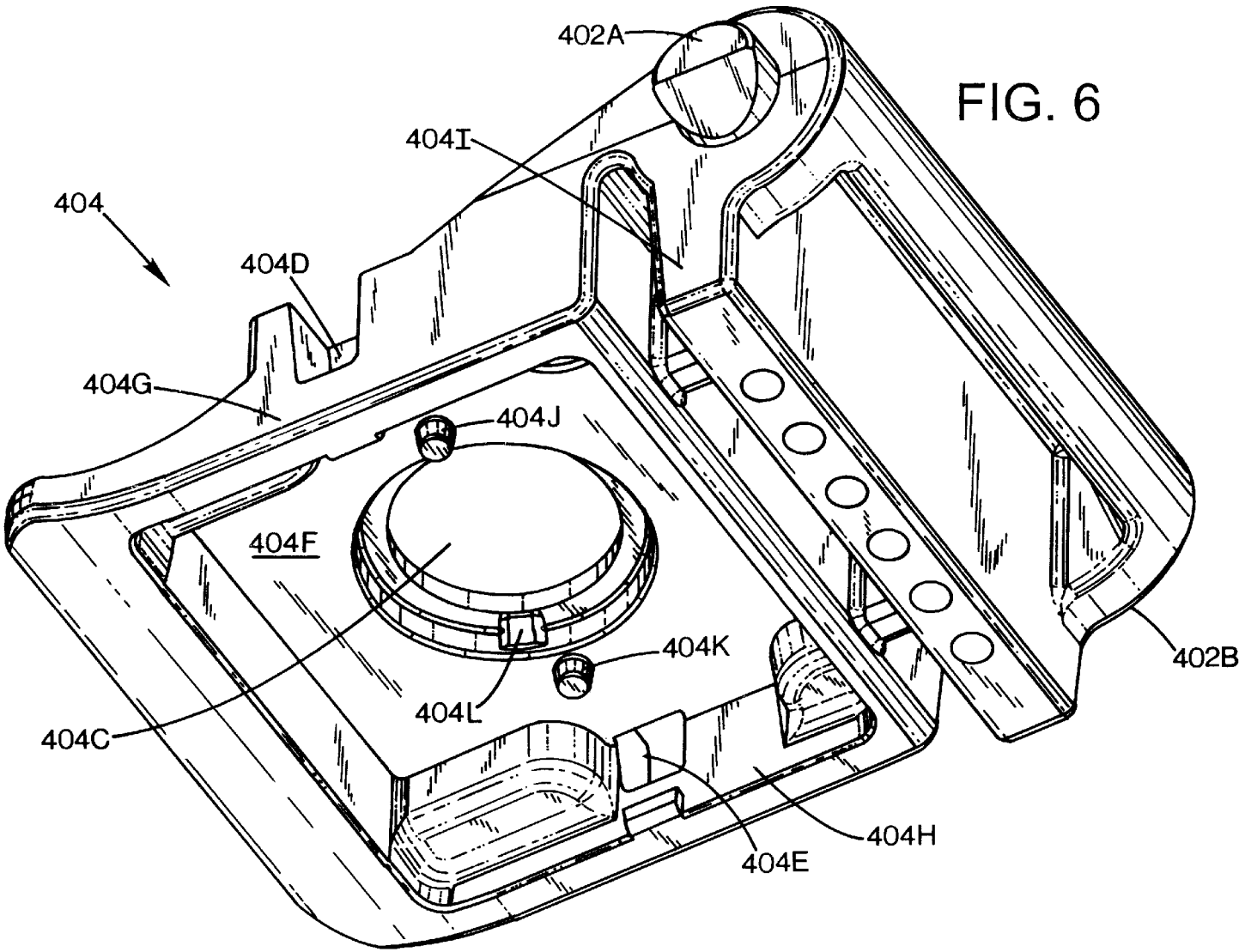
FIG. 6 is an isometric view illustrating the handle of the latch assembly.

The handle 404 is shown in FIG. 6 in further detail, and includes a recessed region 404F in which a stepped opening 404C is formed to receive the hub 410. Slots 404D, 404E are formed in opposed sidewall portions 404G, 404H, and allow the distal ends of the striker elements 412, 414 to protrude through the sidewall portions and into the base slots 402A, 402B to lock the handle in the closed position. Limit stops 404J, 404K protrude from the recessed region 404F.

Figure 7A:
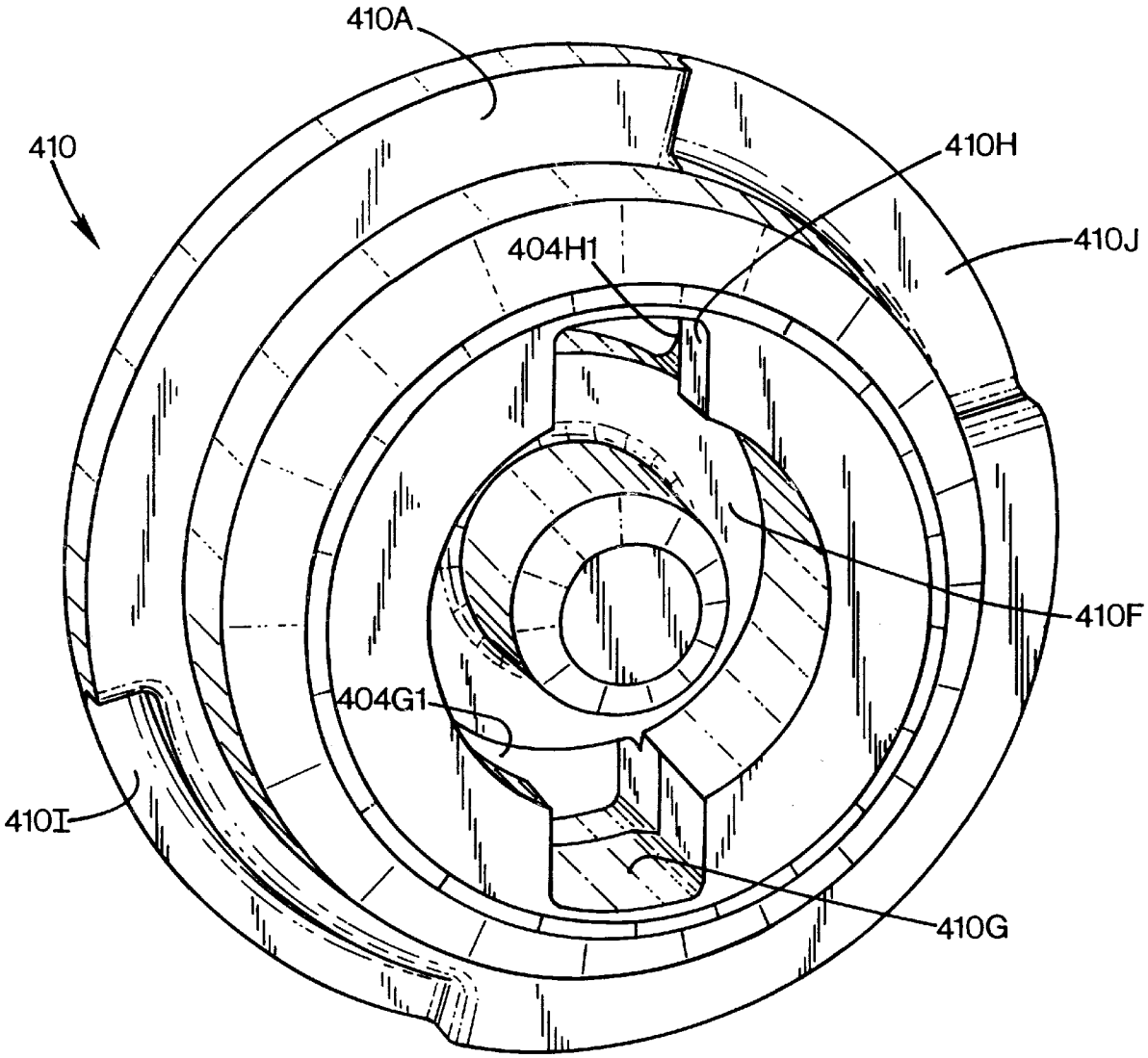
FIGS. 7A–7B illustrate the hub of the latch assembly.
Figure 7B:
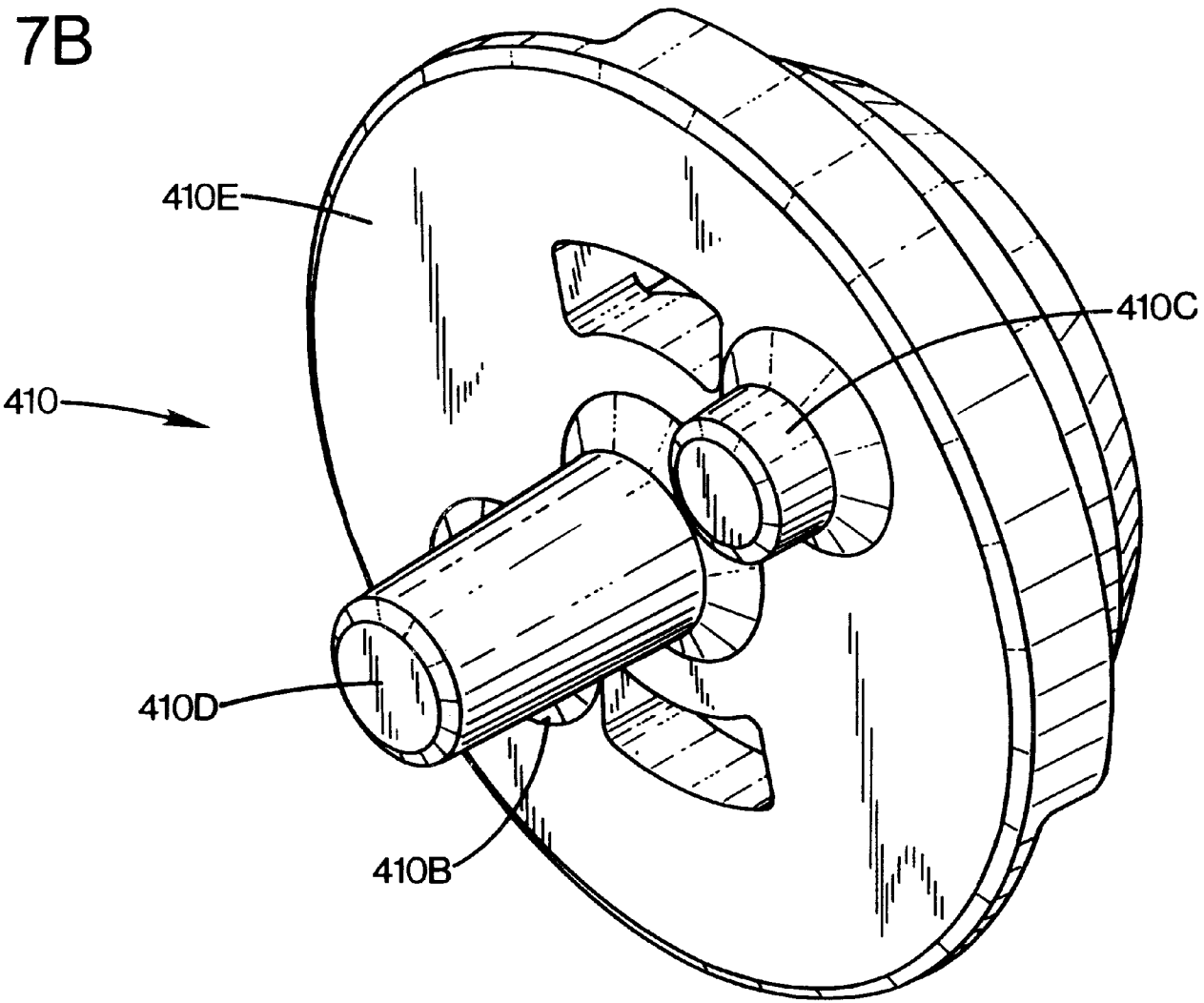

The hub 410 is shown in FIG. 7, and includes a bevelled peripheral edge 412A, a pair of opposed side pin portions 410B, 410C formed in hub surface 410E, and a protruding center pin portion 410D protruding from hub surface 410E. The pin portions 410B, 410C are received in sockets formed in the interior ends of striker elements, and in this embodiment act as crank pins with the socket ends of the striker elements. The center pin portion extends through a corresponding opening in the backplate, and provides a pivot point about which the hub rotates.

Figure 8A:
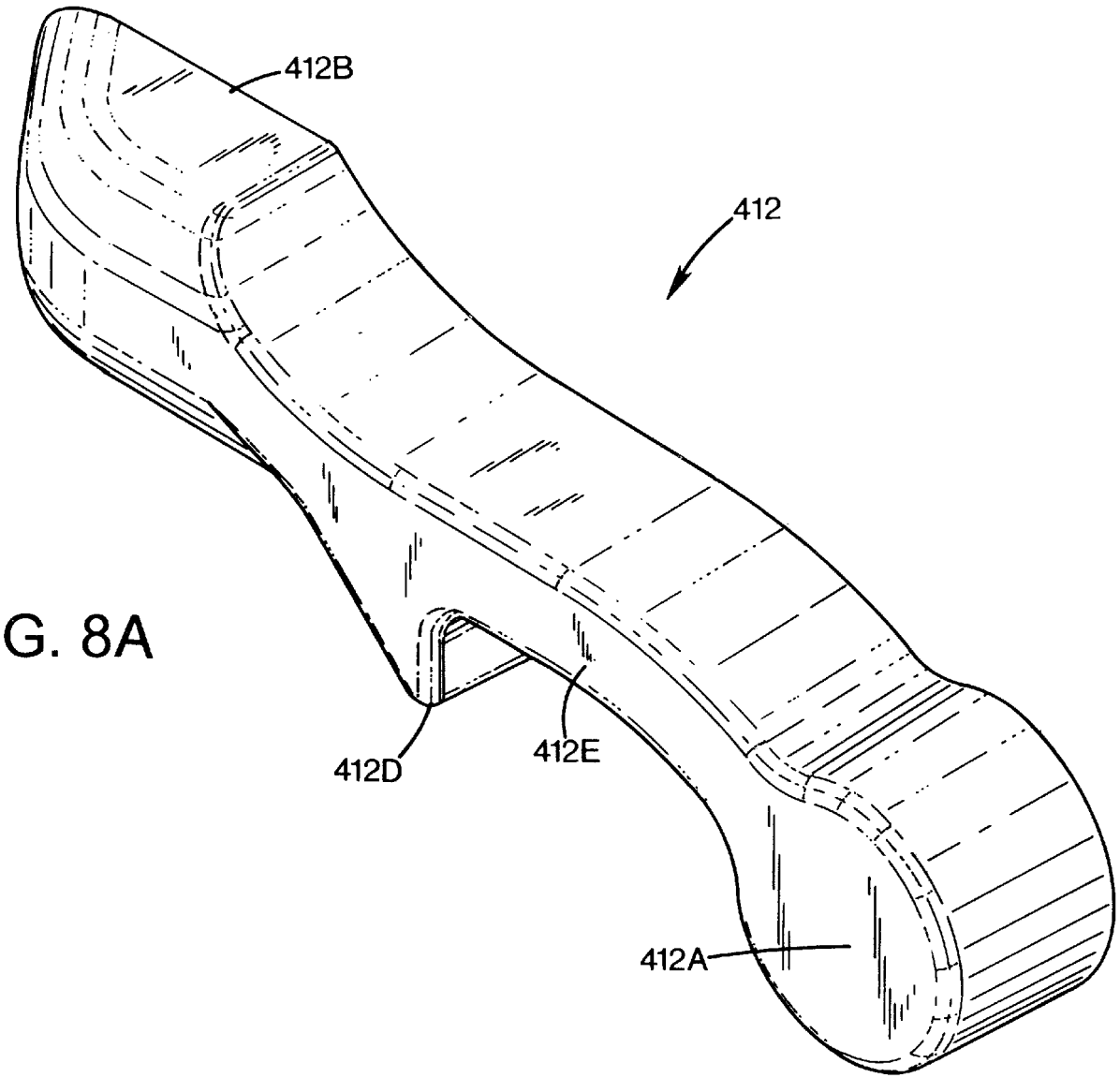
FIGS. 8A–8B show an exemplary one of the striker elements of the latch assembly.
Figure 8B:
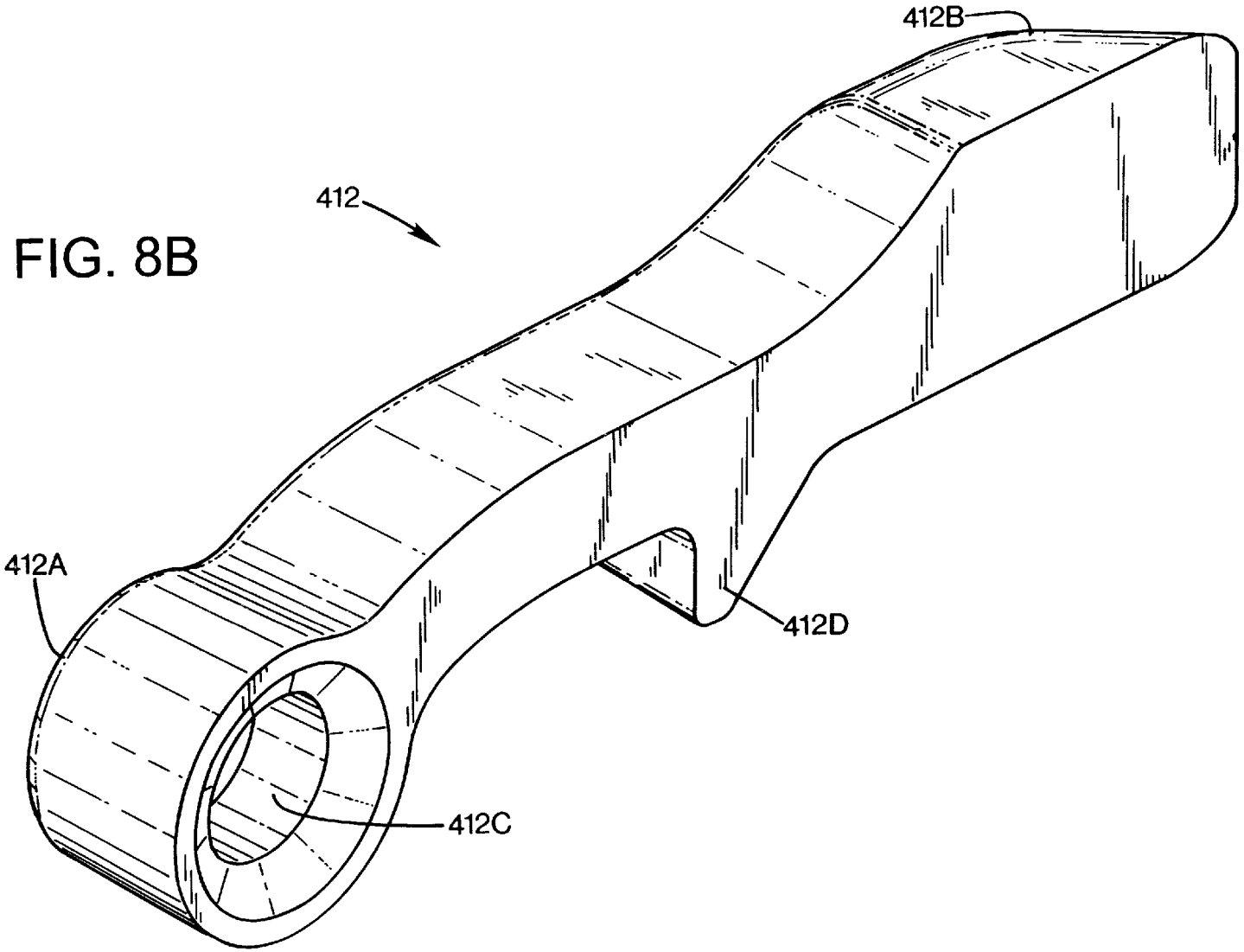

FIGS. 8A–8B show exemplary striker element 412, with interior end 412A and distal end 412B. A socket 412C is formed in the interior end 412A, to receive a corresponding pin portion 410B or 410C of the hub 410. Thus the interior or socket end of the striker element is allowed to rotate about the pin portion of the hub as the hub is rotated on its axis at center pin 410E. The striker element further includes a triangular shoulder portion 412D which extends in a generally transverse direction relative to the striker element body, and a region of reduced cross-sectional dimension or thickness 412E between the interior end 412B and the finger 412D.

Figure 9:
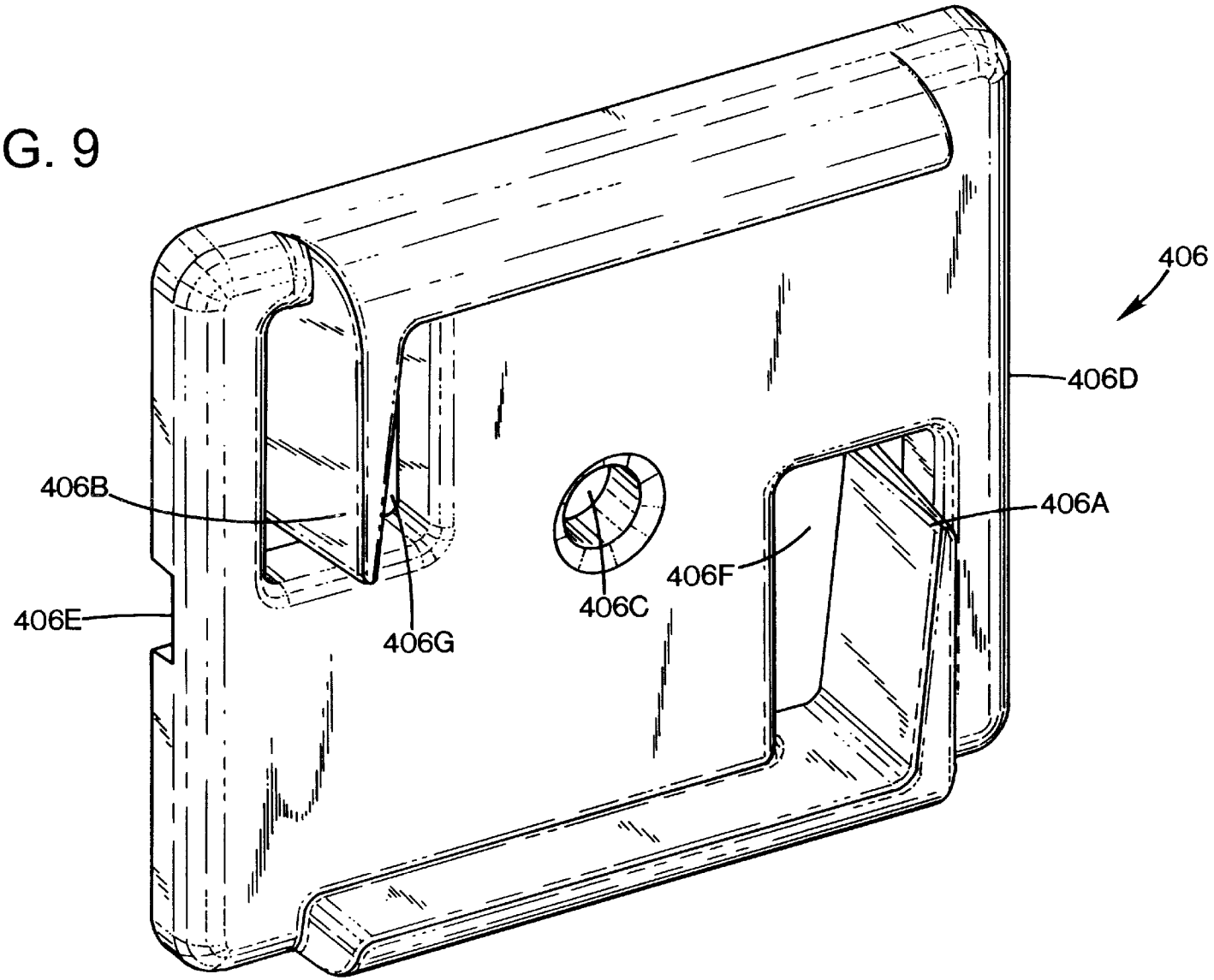
FIG. 9 is an isometric view of the backplate of the latch assembly.

The latch 40 further includes the backplate 406, shown in more detail in FIG. 9. The backplate has defined therein pivot/spring elements 406A, 406B, center opening 406C, and side channels 406D, 406E which are engaged by protruding tab portions 4041, 404J (FIG. 6) to hold the backplate in assembled position in the handle. The pivot/spring elements 406A, 406B are defined within open areas 406F, 406G formed in the backplate. The pivot/spring elements have a tip region of reduced cross-sectional dimension relative to its base region. The tip region acts as a fulcrum point for pivoting movement of the striker element. Moreover, the pivot/spring elements have sufficient resiliency to flex as force is applied to the striker elements, allowing some linear movement of the striker elements along their longitudinal axes.

Each of the striker elements 412, 414 is designed to flex in the area of narrowed cross-sectional dimension, e.g. area 412E for element 412. Two striker elements are used for each latch in this exemplary embodiment, and they are installed, along with the hub 410, into the handle 404, as illustrated in FIG. 11. The socket ends of the striker elements engage with the outer pins 410B, 410C in the hub 410, with the distal or outboard ends of the striker elements passing through the windows or apertures in the sides of the handle. Thus, the striker elements are pushed outwardly as the hub is rotated in one direction and, conversely, are drawn inwardly when the hub is rotated in the other direction.

The hub has two circumferential slots 4101, 410J (FIG. 7A) which engage with two protrusions on the handle, including protrusion 404L (FIG. 6) for the purpose of governing the freedom of rotation of the hub 410. In this exemplary embodiment, the hub rotation is limited by the interaction of the slots with the respective protrusions.

The outboard ends 412B, 414B of the striker elements 412, 414 have bevelled profiles, and engage with the apertures 402A, 402B in the side walls 402E, 402F of the base, so that, when the latch handle is moved in the direction to close the latch, the strikers will first contact the top surfaces of the side walls of the base and then be pushed inwardly (due to the beveled profile of their ends) until they align with the respective apertures in the side walls of the base, at which time they move outward through the apertures to lock the handle.

Figure 12:
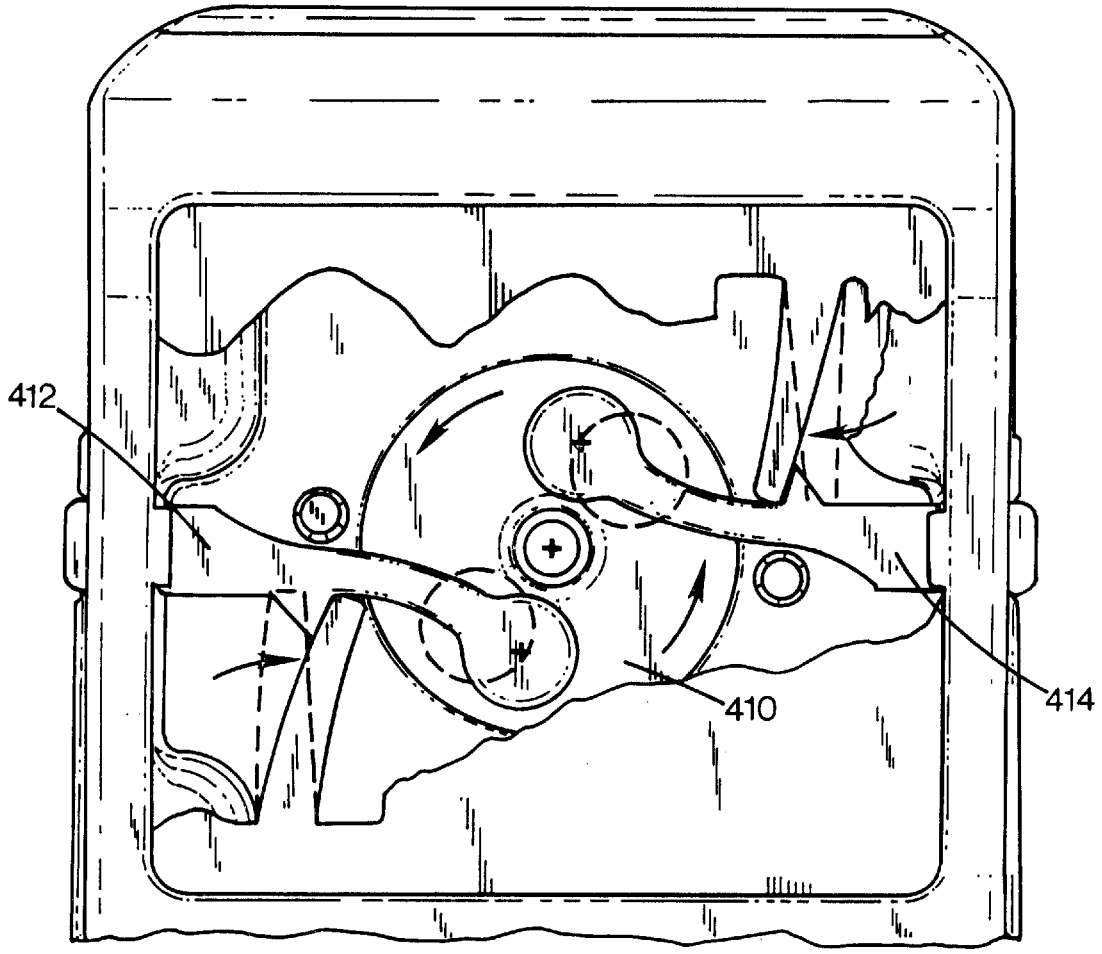
FIG. 12 is a view similar to FIG. 11, but showing the strikers in a retracted position.

The action of the striker elements is further controlled by the backplate 406. The backplate fingers 406A, 406B, incorporated into its profile, act as pivots and springs and, when the backplate is in assembled position, are positioned relative to the striker elements such that their tips sit directly inboard of the triangular shoulders of the striker elements, as illustrated in FIGS. 11 and 12. Thus, when the striker element is required to move inward to release its outboard end from engagement with the base, the striker element has to flex the finger, since the striker shoulder is in engagement with the finger, which acts as a spring to return the striker to the outboard position, as illustrated in FIG. 12. The tip of the finger also acts as a pivot, to support the outboard end of the striker. Thus, the striker has to flex as it moves inward and, therefore, acts as its own spring, wanting to return itself to the outboard position as well. The flexing finger is an important feature of the design, as it not only acts as a spring, but also eliminates the friction that would be generated if the slider were to be dragged over a fixed pivot.

Figure 10:
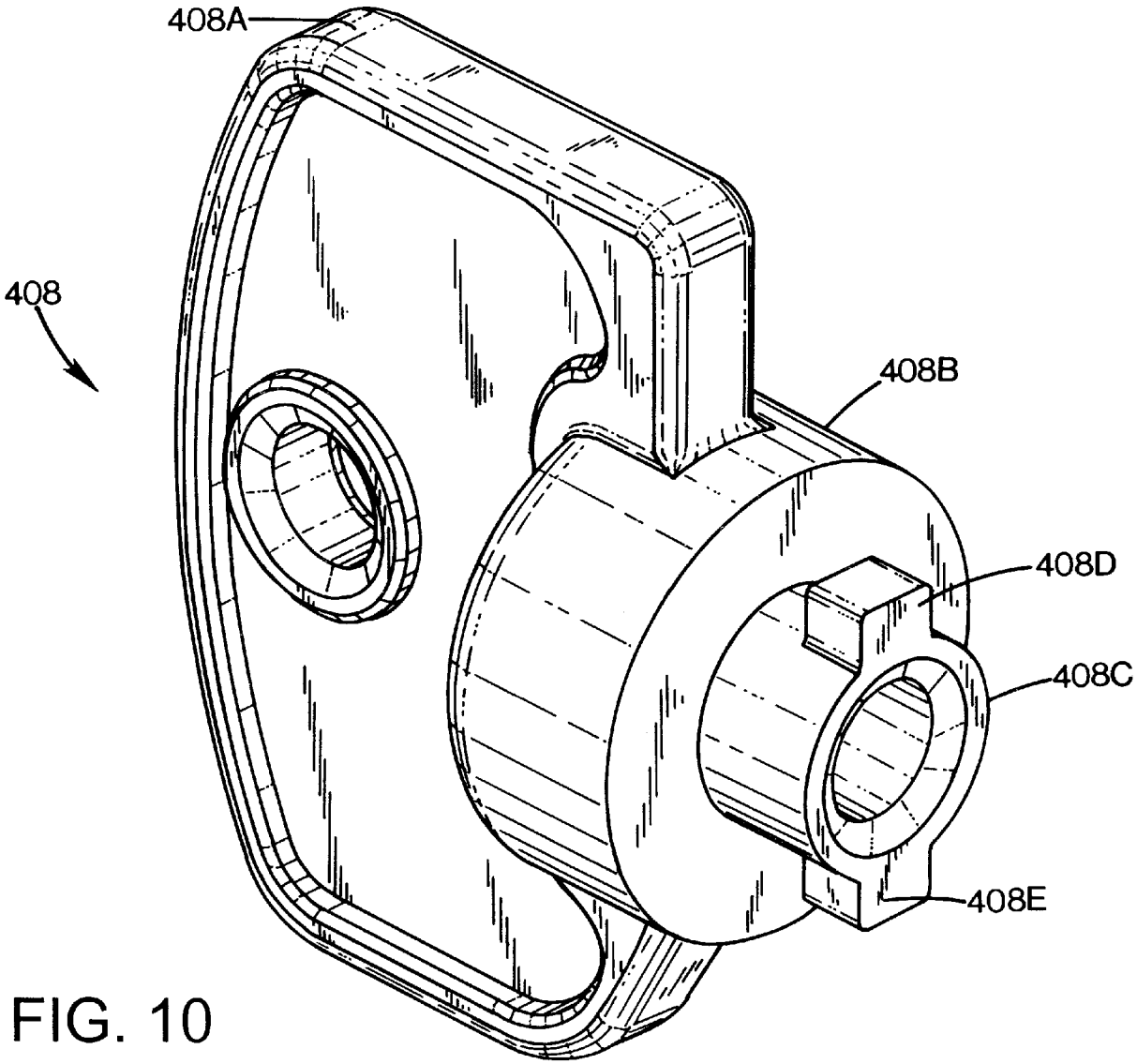
FIG. 10 is an isometric view illustrating the key of the latch assembly.

Now, with the latch locked in the closed position, the hub has to be rotated to pull the sliders inboard to release the latch. This is accomplished with the key 408, which engages with the hub 410. The key is illustrated in FIG. 10, and includes a handle portion 408A attached to a first cylindrical portion 408B. Protruding from the first cylindrical portion 408B is a second cylindrical portion 408C having a diameter sized to fit into the hub opening 410 (FIG. 7A). A pair of opposed protruding key lugs 408D, 408E extend from the periphery of the cylindrical portion 408C, and are sized to engage with relieved areas 410G, 410H formed in the hub 410 (FIG. 7A). With the key mated with the hub, the handle portion of the key is rotated by the user, which thereby imparts a rotational force on the hub 410. When the key is rotated in the direction required to open the latch, the key lugs 408D, 408E engage with and enter the undercut areas 410G1, 410H1 which communicate with relieved areas 410G, 410H in the hub, such that the user can pull open the handle with the key as a one-handed operation.

Thus, the latch can be locked by the simple act of closing it, and can only be unlocked with the key. The user of the spa/pool can secure the spa or pool by engaging the webbing straps into the latches (which are fastened to the sides of the pool/spa) and snapping the latches shut. The dexterity required to insert the key and turn it in the right direction would defeat a small child. However, in this embodiment, the latches are not intended to secure the spa against a serious attempt at access by an adult or more mature child.

Figure 13:
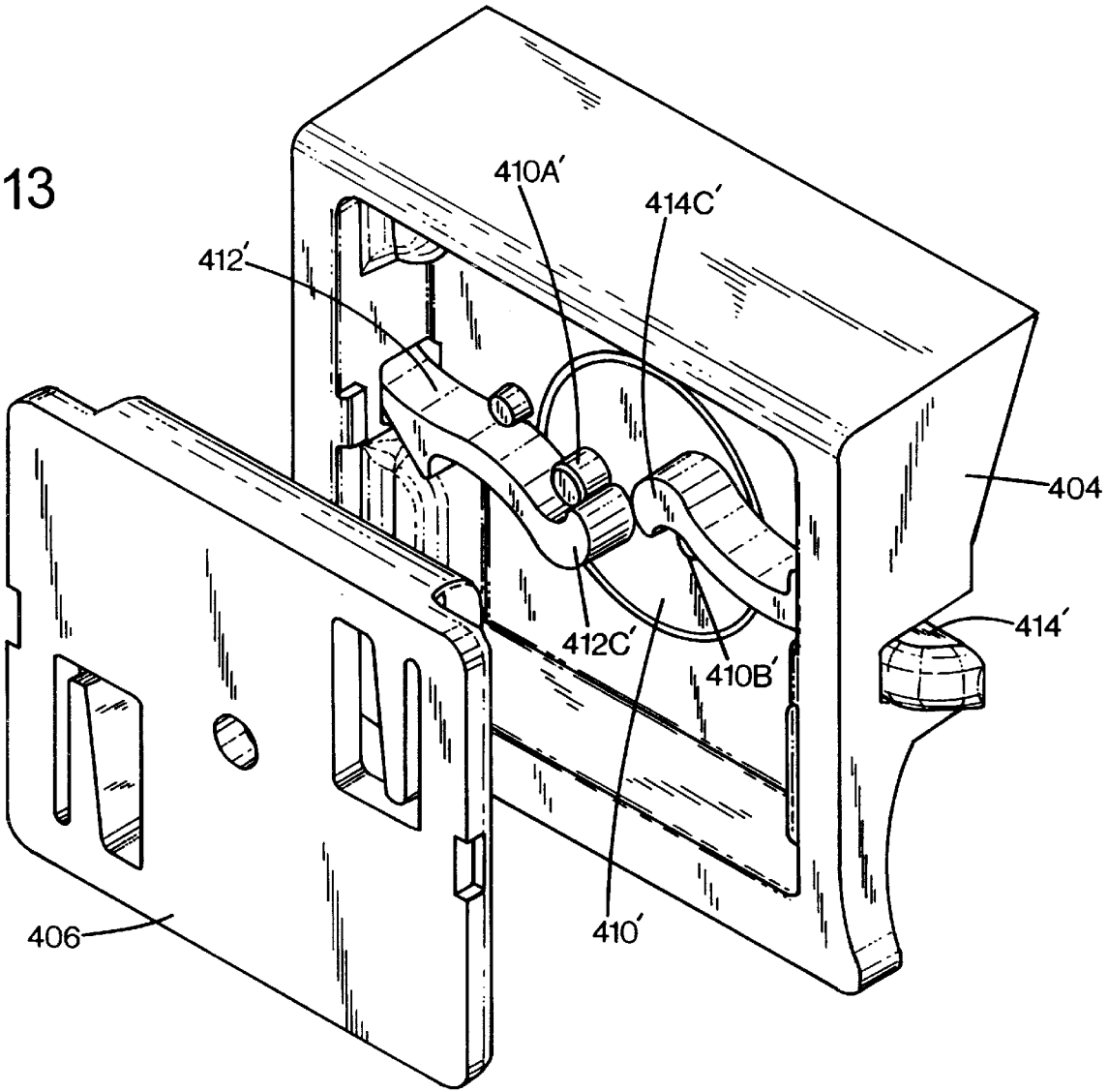
FIG. 13 is a partially exploded view of an alternate embodiment of portions of the latch.

The invention is not limited to a mechanism having two strikers, since the striker/hub combination could be employed with a single striker, or with a greater number of strikers than two. Moreover, the rotational movement of the hub can be a continuous movement, in a single direction, allowing the strikers to cyclically deploy. This alternate embodiment is shown in FIG. 13, illustrating a handle 404 with the base plate 406 in exploded view. For this embodiment, the striker elements 412', 414' and the hub 410' are modified from the form of the corresponding elements of the embodiment of FIGS. 1–12, to allow full rotation of the hub 410' in a counterclockwise (CCW) sense. The striker elements do not include a socket end which receives a hub pin as in the embodiment of FIG. 8B. Instead, the ends 412C', 414C' of the striker are curved to provide cam surfaces periodically contacted by pins 410A', 410B' as the hub is rotated CCW, causing the outboard ends to be withdrawn as in the first embodiment. As the hub continues its rotation, the striker elements flex sufficiently due to forces exerted by the pins 410A', 410B' that striker ends ride over the pins, allowing the strikers to return to the extended, rest position by the spring force exerted by the plate fingers. As the hub further continues its rotation, the pins will again contact the inboard ends of the striker elements, repeating the action.

The invention is also not limited to a latch. An aspect of the invention involves the use of a striker/hub combination which translates rotary motion of the hub into reciprocating motion of the striker directly and with minimal friction and a dual spring return, or vice versa (translating linear motion into rotary motion). This has applications in a number of other areas, including mechanisms for opening/closing, door latches, locks, container lid latches/locks, snap-on medicine container lids.

Another aspect of the invention is that rotational movement is translated into linear or reciprocating movement without a connecting rod as a third link. In the case of the latch described with respect to FIGS. 1–12, the rotational movement of a few degrees is translated into a linear movement of the latch striker elements, retracting them inwardly to release the latch. The pivot springs ensure that the striker elements return to their rest position when the rotational force is removed.

The invention can be employed in other lock configurations that the exemplary embodiments described above. However, the invention is not limited to lock applications. For example, the pivot springs and the striker elements can be reoriented such that the pivot springs hold the strikers in the inboard position until pushed out by the rotational force. Other exemplary applications include printing machines, in which the end of the striker is a character or a dot for a matrix application. The same principle can be employed in a machine for perforating paper or metal, e.g. a Braille printer. Other exemplary applications include those in which it is desirable to reduce the number of moving parts and need for lubrication, e.g. in a firearm as a firing pin.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A mechanism for converting between rotational and linear movement, comprising:

a rotatable hub structure;

a striker element having an inboard end and an outboard end, the striker element fabricated of a material having some flexibility;

a pivot/spring structure positioned to engage a pivot location on the striker element between the inboard and outboard ends of the striker element, said structure providing a deflectable pivot fulcrum which can be deflected from a rest pivot rest position in response to a deflecting force exerted on the striker element;

the hub structure positioned for engagement with the inboard end of the striker element so that a rotational movement of the hub structure provides a force on said striker element tending to cause said inboard end to pivot about the pivot structure, deflecting the pivot fulcrum such that the outboard end of the striker element moves in the axial direction.

2. The mechanism of claim 1 wherein:

the hub structure includes a protruding pin disposed apart from a center of rotation of the hub structure;

the striker element includes a pin-receiving socket, the striker element arranged such that the hub pin is disposed in said socket so that force is transmitted between the hub and striker element through said pin and socket.

3. The mechanism of claim 1 wherein:

the hub structure includes a protruding pin disposed away from a center of rotation of the hub structure; and said inboard end of said striker element includes a pin-engaging cam surface;

wherein as said hub structure is rotated about said center of rotation, said pin engages said hub surface of said striker element to transmit force to said striker element.

4. The mechanism of claim 3 wherein said hub engaging surface has a curved profile to allow said surface to disengage from said pin as the hub is rotated.

5. The mechanism of claim 1 wherein the pivot/spring structure includes a finger element having a tip, the tip engaging the pivot location of the striker element.

6. The mechanism of claim 5 wherein the striker element has a protruding shoulder to define said pivot location of the striker element, the tip of the finger element engaging against the shoulder during a pivoting movement.

7. The mechanism of claim 1 wherein the striker element includes an area of reduced thickness between the pivot location and the inboard end to facilitate flexing of the striker element at the area of reduced thickness.

8. The mechanism of claim 1 wherein the hub structure is constrained for rotation about an axis of rotation, and said axial direction is transverse to said axis of rotation.

9. The mechanism of claim 1, wherein the force exerted by the hub structure has an axial force component in an axial direction along a striker axis and a transverse force component in a direction transverse to the axial direction.

10. A latch, comprising:

a base structure;

a handle structure mounted to the base structure for pivoting movement about a handle pivot between an open position and a latch position;

the base structure including a flange member positioned adjacent the latch position and including an aperture formed therein;

a latch mechanism carried on the handle structure, comprising:

a rotatable hub structure;

a striker element having an inboard end and an outboard end, the striker element movable from a rest position wherein the outboard end protrudes into said base structure aperture when the handle is in the latch position to a release position wherein the outboard end is disposed out of said flange aperture;

a pivot/spring structure positioned to engage a pivot location on the striker element between the inboard and outboard ends of the striker element, said structure providing a deflectable pivot fulcrum which can be deflected from a pivot rest position in response to a deflecting force exerted on the striker element;

the hub structure positioned for engagement with the inboard end of the striker element so that a rotational movement of the hub structure provides a force on said striker element tending to cause said inboard end to pivot about the pivot structure, deflecting the pivot fulcrum such that the outboard end of the striker element moves inwardly from the rest position to release the latch.

11. The latch of claim 10, further comprising a key for engaging the hub and applying a rotational force on the hub to release the latch.

12. The latch of claim 11 wherein the key is removable from the hub.

13. The latch of claim 10, wherein the key includes one or more hub engaging features which engage corresponding hub undercut features to allow the user to exert a pulling force on the key while engaging the undercut features to open the latch.

14. The latch of claim 10, wherein the handle structure includes a recessed region having an opening formed in which the hub structure is mounted, and a backplate structure for covering the recessed region, the backplate structure carrying the pivot/spring structure.

15. The latch of claim 14, wherein the backplate structure supports in relative operating position the hub structure and the striker element.

16. The latch of claim 10, wherein:

the hub structure includes a protruding pin disposed apart from a center of rotation of the hub structure;

the striker element includes a pin-receiving socket, the striker element arranged such that the hub pin is disposed in said socket so that force is transmitted between the hub and striker element through said pin and socket.

17. The latch of claim 10 wherein:

the hub structure includes a protruding pin disposed away from a center of rotation of the hub structure; and said inboard end of said striker element includes a pin-engaging cam surface;

wherein as said hub structure is rotated about said center of rotation, said pin engages said cam surface of said striker element to transmit force to said striker element.

18. The latch of claim 17 wherein said pin-engaging surface has a curved profile to allow said surface to disengage from said pin as the hub is rotated.

19. The latch of claim 10 wherein the pivot/spring structure includes a finger element having a tip, the tip engaging the pivot location of the striker element.

20. The latch of claim 19 wherein the striker element has a protruding shoulder to define said pivot location of the striker element, the tip of the finger element engaging against the shoulder during a pivoting movement.

21. The latch of claim 10 wherein the striker element includes an area of reduced thickness between the pivot location and the inboard end to facilitate flexing of the striker element at the area of reduced thickness.

22. The latch of claim 10 wherein the hub structure is constrained for rotation about an axis of rotation, and said axial direction is transverse to said axis of rotation.

23. A key-operated locking latch, comprising:

a base structure;

a handle structure mounted to the base structure for pivoting movement about a handle pivot between an open position and a latch position;

the base structure including opposed first and second flange members positioned to receive the handle structure therebetween when the handle is in the latch position, said flange members having respective first and second apertures formed therein;

a latch mechanism carried on the handle structure, comprising:

to a rotatable hub structure;

opposed first and second striker elements, each having an inboard end and an outboard end, the striker element movable from a rest position wherein the outboard end protrudes into a corresponding one of said flange apertures when the handle is in the latch position to a release position wherein the outboard end is disposed out of said flange aperture;

first and second pivot/spring structures, each respectively positioned to engage a pivot location on the striker element between the inboard and outboard ends of the striker element, each said structure providing a deflectable pivot fulcrum which can be deflected from a pivot rest position in response to a deflecting force exerted on the striker element;

the hub structure positioned for engagement with the respective inboard ends of the striker element so that a rotational movement of the hub structure provides a force on said striker elements tending to cause said inboard ends to pivot about the pivot structure, deflecting the pivot fulcrums such that the outboard ends of the striker elements move inwardly from the rest position to release the latch; and a key for engaging the hub and applying a rotational force on the hub to release the latch, the key removable from the handle.

24. The latch of claim 23, wherein the handle structure includes a recessed region having an opening formed in which the hub structure is mounted, and a backplate structure for covering the recessed region, the backplate structure carrying the pivot/spring structure.

25. The latch of claim 24, wherein the backplate structure supports in relative operating position the hub structure and the striker element.

26. The latch of claim 23, wherein the key includes one or more hub engaging features which engage corresponding hub undercut features to allow the user to exert a pulling force on the key while engaging the undercut features to open the latch.

* * * * *